US006270445B1

(12) United States Patent
Dean, Jr. et al.

(10) Patent No.: US 6,270,445 B1
(45) Date of Patent: Aug. 7, 2001

(54) IN-BED EXERCISE MACHINE AND METHOD OF USE

(75) Inventors: Robert C. Dean, Jr., Norwich, VT (US); Solomon Diamond, Cambridge, MA (US); Elizabeth K. Deneen, Tunbridge; Amanda G. Heermans, White River Junction, both of VT (US); Gayle B. O'Neil, Grantham; David S. Smith, Meridan, both of NH (US)

(73) Assignee: Simbex LLC, Lebanon, NH (US)

( * ) Notice: Subject to any disclaimer, the term of this patent is extended or adjusted under 35 U.S.C. 154(b) by 0 days.

(21) Appl. No.: 09/666,740

(22) Filed: Sep. 20, 2000

Related U.S. Application Data

(62) Division of application No. 09/496,456, filed on Feb. 2, 2000, now Pat. No. 6,152,855.
(60) Provisional application No. 60/118,351, filed on Feb. 3, 1999.

(51) Int. Cl.[7] ..... A63B 21/00
(52) U.S. Cl. ..... 482/4; 482/51; 482/114; 482/120; 482/127; 601/24
(58) Field of Search ..... 482/1–9, 51, 66, 482/92, 114–116, 120–127; 601/23, 24, 26–35

(56) References Cited

U.S. PATENT DOCUMENTS

| | | |
|---|---|---|
| 4,169,591 | 10/1979 | Douglas . |
| 4,615,335 | 10/1986 | Searcy . |
| 4,635,931 | 1/1987 | Branrsten . |
| 4,925,184 | 5/1990 | McJunkin et al. . |
| 4,976,426 | 12/1990 | Staho et al. . |
| 4,979,737 | 12/1990 | Kuck . |

(List continued on next page.)

OTHER PUBLICATIONS

Laukkanen, P., Heikkinen, E., Kauppinen, M., Muscle Strength And Mobility As Predictors Of Survival In 75–84 Year Old People. Age and Aging, 24:468–473, 1995.

Institute of Medicine, Disability in America: Toward a National Agenda for Prevention. Washington, DC., National Academy Press, 1991.

Flech, S.J. and Kraemer, W.J., Designing Resistance Traingin Programs, 2nd ed. Champaign, IL, Human Kinetics, 1997.

(List continued on next page.)

*Primary Examiner*—Glenn E. Richman
(74) *Attorney, Agent, or Firm*—BJ Associates; Bolesh J Skutnik

(57) ABSTRACT

Methods of use of a portable in-bed exercising machine are provided for strengthening and/or strength maintenance of the musculature and ligaments associated with an extremity. The exercise apparatus employs the principles of closed kinetic chain exercise of the extremity in both concentric and eccentric modes and for isometric, isotonic and isokinetic exercise. Each extremity is engaged separately allowing for bilateral, unilateral and reciprocal motion. As exemplified for lower extremities, force is actively applied to the feet with each lower extremity having the force level continuously adjustable from zero force to a force equal to or greater than body-weight The exercise motions and force applications use the same major muscle groups as functional activities such as standing from a chair, climbing stairs walling, jumping and jogging. Vertical support is provided for the lower extremity to stabilize and control the lower extremity motion within safe limits. Back support is provided for the user to exercise in a supine position. Almost any bed may be integrated with the force producing machine to form the exercise apparatus. The methods of use are adaptable to low gravity environments such as space stations, space shuttles, and other space-like environments.

9 Claims, 7 Drawing Sheets

U.S. PATENT DOCUMENTS

| | | | | |
|---|---|---|---|---|
| 5,005,829 | | 4/1991 | Caruso . | |
| 5,207,628 | | 5/1993 | Graham . | |
| 5,312,315 | | 5/1994 | Mordensen et al. . | |
| 5,820,519 | | 10/1998 | Slenker . | |
| 5,984,844 | * | 11/1999 | Royer | 482/133 |
| 6,053,850 | * | 4/2000 | Martinez | 482/74 |

OTHER PUBLICATIONS

Steinberg, F., Medical Evaluation, Assessment Of Function And Potential, And Rehabilitation Plan. In: Rehabilitation of the Aging and Elderly. G. Felsenthal, S. Garrison, F. Steinberg, Wilkins and Wilkins, 428 East Preston street, Baltimore, MD. 1994.

Clark, G.S., Siebens, H.C., Rehabilitation Of The Geriatric Patient. In Rehabilitation Medicine: Principles and Practices, Second Edition, edited by Joel A. DeLisa. J.B. Lippincott Company, Philadelphia, 1993.

Bassey, E.J., Bendall, M.J., Pearson, M., Muscle Strength In The Triceps Surae And Objectively Measured Customary Walking Activity In Men And Women Over 65 Yrs of Age. Clin Sci Lond, 74:85–89, 1988.

Bassey, E.J., Fiatarone, M.A., O'Neill, E.F., Kelly, M., Evans, W.J., Lipsitz, L.A., Leg Extensor Power And Functional Performance In Very Old Men And Women. Clinical Sci. 82: 321–327, 1992.

Skelton, D.A., Greig, C.A., Davies, J.M., Young, A., Strength, Power And Related Functional Ability Of Healthy People Aged 65–89 Years. Age and Aging. 23: 371–377, 1994.

Lamb, S.E., Morse, R.E., Evans, J.G., Mobility After Proximal Femoral Fracture: The Relevance Of Leg Extensor Power, Postural Sway And Other Factors. Age and Aging. 24: 308–314, 1995.

Ames Research Center, Device for Leg Exercise in Low or Normal Gravitation, NASA Tech Briefs, Oct. 1996.

* cited by examiner

IN-BED EXERCISE MACHINE AND METHOD OF USE

1. Domestic Priority Under 35 USC 119(e)**

This application is a divisional and claims the benefit of U.S. Ser. No. 09/496,456, now U.S. Pat. No. 6,152,855, filed Feb. 2, 2000 and in turn claimed benefit of U.S. Provisional Application No. 60/118,351, filed Feb. 3, 1999.

BACKGROUND OF THE INVENTION

2. Field of Invention

This patent relates to the use of exercise machines, specifically to an exercising regime for a person while in bed. The invention can also be used as a physical therapy and rehabilitation programs to restore and/or maintain functional mobility in bedridden patients.

3. Information Disclosure Statement

For the geriatric population especially, losing the muscle strength that is required to get up out of bed and walk with confidence can mean the difference between independent living and permanent dependence on others. Decreased functional mobility has a drastic effect on quality of life and has been found to significantly predict mortality. (Laukkanen, P., Heikkinen, E., Kauppinen, M., *Muscle Strength And Mobility As Predictors Of Survival In* 75–84 *Year Old People*. Age and Aging, 24:468–473, 1995.) Addressing the loss of functional mobility in the elderly through appropriate exercise programs will reduce long term health care costs and improve the quality of life of the elderly.

One major cause of decreased functional mobility especially in the elderly is disuse atrophy of the thigh and leg muscles. Rapid disuse atrophy of the thigh and leg muscles of the elderly occurs during 5–10 days of bedrest in the bospital. In 1979, the elderly experienced 14.8 hospitalizations per 100 persons per year compared to 9.8 in the general public (Institute of Medicine, Disability in America: *Toward a National Agenda for Prevention*. Washington, DC., National Academy Press, 1991). Hospitalized patients, institutionalized residents, and those returning home after hospitalization are all at risk of muscular atrophy and subsequent mobility impairment due to extended bedrest. In fact, the return to premorbid function after a period of bedrest can take longer than the recovery from the original illness.

In today's hospital, nursing home and home-care settings, bed-ridden patients are dependent on physical therapists to provide the necessary exercise. The exercise provided manually by a physical therapist often does not adequately exercise tee thigh and leg muscles. Adequate exercise of the thigh and leg muscles can be achieved by following these seven basic principles of resistance training (Flech, S. J. and Kraemer, W. J., *Designing Resistance Training Programs,* 2nd ed. Champaign, Ill., Human Kinetics, 1997).

1. Overloading of the muscles must occur through voluntary muscular actions. For the thigh and leg muscles, this requires a level of force up to and in excess of the patient's body weight. Physical therapists cannot achieve or sustain the production of body-weight-level force at bedside.

2. Intensity during exercise is required to increase the power output of the muscles and not just their ability to overcome maximal resistances. Intensity is achieved by moving against resistance with rapid speed. Physical therapists cannot sustain manually the necessary resistance and rapid motion.

3. Training volume is a measure of the total work (Joules) performed over a time period. Training volume is important to the development lean body mass and to decreasing body fat. Physical therapists cannot measure the training volume of the exercise they provide at bedside.

4. Periodization refers to incorporating variation in training volume and intensity. Periodization is essential for optimal gains in strength. Without the ability to measure training volume and intensity, physical therapists cannot take fill advantage of the benefits of periodization.

5. Progressive overloading of the muscles is required to produce gains in strength and power. This is accomplished by progressively increasing the force level, the number of exercise sets and the training volume. Physical therapists can only provide progressive overloading within their own strength and endurance capabilities.

6. Rest periods between sets of an exercise, between exercises and between training sessions are essential to the success of a program. Rest periods should be determined in accordance with the goals of the timing program and should not be restricted by the availability of a physical therapist.

7. Specificity means that each muscle group requiring strength must be trained in a fashion similar to that required during use. The actions of walking, ascending and descending stairs, sitting down and standing up require multiple joint movements with concentric and eccentric power production in reciprocal and bilateral leg extension with body-weight-level forces. As explained above, physical therapists cannot manually orchestrate exercises that simulate these actions at bedside.

The elderly are often caught in a vicious cycle. They may be confined to bed as a result of a fall, a physical illness, depression or a lifestyle change. Without adequate exercise, their leg muscles atrophy in a week or two and they lose strength. They continue to weaken from lack of exercise. Eventually, they often lose the strength required to get up and walk. The end result is a complete bedridden state and total dependence on others. Herein, "bedridden" means any individual who cannot rise from a supine or seated position without assistance and who cannot walk without assistance and who has remained in this condition for more than two consecutive weeks. This depressing situation will only worsen as the healthcare system experiences further cost pressures, and as our population ages.

Physical therapy gyms have successfully integrated some technologies which simulate walking and weight-bearing motions (e.g. the horizontal "leg press," the recumbent cycle ergometer, the Cybexe®, (registered trademark of CyBex International, Inc.) and the NuStep® (registered trademark of Life Plus, Inc.). Similarly, physical therapy gyms may employ a combination of supine exercisers such as the Total Gym®, (registered trademark of Engineering Fitness International Corp.) Shuttle® (registered trademark of Contemporary Design Co.). Unfortunately, all of the devices that are capable of providing adequate exercise require that patients transfer from the bed to another location. Such transfer is labor intensive for a hospital or nursing home and is often dangerous and traumatic for a deconditioned patient. For these reasons, it is best for bedridden patients to exercise in bed.

In order to provide adequate exercise as defined by the above described seven principles, in the context of a bed, the following three criteria must be met:

I. A means of providing forces up to body weight and a bit beyond

II. A means of joining any bed and the exercise machine into a single exercise unit that is capable of safely supporting said body-weight-level forces and the reaction forces from the patient.

III. A means of providing said forces in a manner that simulates weight bearing and functional activity. Functional activities involve multiple joint motions that are both concentric wherein the muscle contracts under tension and eccentric wherein the muscle elongates under tension.

A review of patents on In-Bed Exerciser equipment illustrates how the state of the art fails to meet these three criteria for an In-Bed Exerciser capable of providing adequate exercise.

U.S. Pat. No. 5,820,519 describes an exercising machine designed for use in bed. This exercise machine is comprised of a torque drum mounted for rotation against a variable resistance torque drum mounted on the headboard of the bed. A cable extends from each torque drum to handles and stirrups tat attach to the hands and feet of the patient in bed. This device allows the patient to do to exercise the upper and lower extremity in a supine position. However, there is no provision in this device that allows for the application of body-weight-level forces. This is evident because all of the forces of exercise are transmitted to the headboard of the bed in the horizontal plane. The headboard of a standard bed is not designed to supporting the body-weight-level forces in the horizontal plane. The resulting torque due to the application of body-weight-level forces into the headboard could result in the catastrophic failure of the bed frame and potential serious injury to the patient. This invention is the same as lifting weights providing concentric and eccentric modes only to the biceps and triceps.

U.S. Pat. No. 5,207,628 is a device that provides for doing various exercises including sit-up and pull-up motions. There is also a provision for the attachment of rubber bands enabling a variety of exercises. Although it is conceivable that body-weight-level forces could be applied with the use of rubber bands, there are three distinct disadvantages. 1) The force provided by a rubber band is dependent on its extension length resulting in an exercise motion that does not resemble the essentially constant force of walling, a knee bend or other functional activities. 2) It is necessary to interchange the rubber band to change the force level which is a cumbersome process and not easily adaptable to fine adjustment of the force level. 3) The use of body-weight-level force rubber bands is potentially dangerous to the patient because of the unrestrained speed and path of motion.

U.S. Pat. No. 5,312,315 is for a pneumatic variable resistance rehabilitation therapy apparatus. This device provides exercise resembling functional activity for injured, weakened and post-operative ligaments and muscles of lower extremity. This device is not designed for use by bedridden patients without transferring the patient from the bed to the exercising machine. It is not obvious how this invention can be adapted for use in bed because of the integral design feature that the bed must shuttle back and forth.

U.S. Pat. No. 5,005,829 is for an exercising device used by patients confined to bed. This device allows the patient to exercise all four limbs. Force is provided by fluid resistance and there is no energy source. With the absence of an energy source, this device is unable to simulate functional activity. The force of exercise is furthermore transferred to the foot board of the bed which is not usually capable of withstanding body-weight-level forces in the horizontal plane.

U.S. Pat. No. 4,979,737 is for an exercising apparatus for the lower extremity for use in bed, on a training table or on the floor with legs extended horizontally. Force is provided with a braking resistance device and not with an energy source.

U.S. Pat. No. 4,976,426 is for an exercising device used by bedridden patients and those in different stages of rehabilitation. This device comprises that least one pair of crank arms and a hydraulic motor to rotate the crank arms with hydraulic power. This device includes a support table and therefore it is necessary to transfer the patient from the bed to this exercise apparatus.

U.S. Pat. No. 4,925,184 comprises a bicycle-like exercising device enabling a patient to exercise while in bed. This device contains no energy source. This device also is not designed to supply body weight level forces to the subject. This device is unable to provide exercises that simulate ambulatory activity.

U.S. Pat. No. 4,635,931 describes a device for exercising the leg and arm muscles of a person lying in bed. The device consists of the bellows that is fastened to the foot board of the bed whereby the bedridden patients can push and pull on the bellows. This is a resistance exercise device. Without energy storage or actuation, this device is not able to provide concentric and eccentric exercise. There is also no provision for the safe accommodation of body-weight-level forces by the bed structure.

U.S. Pat. No. 4,615,335 describes an apparatus for permitting the exercise of a bedridden patient while in bed. This device uses a motorized bicycle for the upper or lower extremity. The method of attachment to the bed is by fastening to the rail along the side of the bed. Because of the way this device is positioned on the bed a patient is not able to exercise both the left and right side at the same time; therefore it does not simulate functional activity.

No product exists that is capable of providing said adequate in-bed exercise for the thigh and leg muscles of bedridden patients. The present invention, an In-Bed Exerciser for use by persons in bed, addresses the shortcomings of the prior art. It can safely provide adequate exercise for the thigh and leg muscles in accordance with the said seven basic principles of resistance training. It can also prevent muscle atrophy during periods of bedrest and thus can be an important rehabilitation tool for any patient attempting to regain functional mobility.

SUMMARY AND OBJECTIVES OF THE INVENTION

It is the object of this invention to provide for a method to apply the basic principles of strength training (i.e. overloading, intensity, trainig volume, periodization, progressive overloading, rest periods and specificity) while also meeting the specific needs of bedridden patients.

It is a further object of this invention to provide methods of using a portable, stand-alone unit that joins with the patient's bed and allows for safe and adequate exercise of muscles in an extremity; that provides for resistance training and aerobic exercise with forces applied during both concentric and eccentric motion; and that allows for bilateral, unilateral, reciprocal exercises either isometric, isotonic or isokinetic exercises or passive motion, all without requiring a patient to transfer from the bed.

It is another object of this invention to provide a method of exercising which uses the same major muscle groups as normal human functional activities which, for lower extremities, include walking, stair climbing, jumping and running.

Briefly stated the present invention provides methods of use of a portable in-bed exercising machine for strengthening and/or strength maintenance of the musculature and ligaments associated with an extremity. The exercise apparatus employs the principles of closed kinetic chain exercise of the extremity in both concentric and eccentric modes and for isometric, isotonic and isokinetic exercise. Each extremity is engaged separately allowing for bilateral, unilateral and reciprocal motion. As exemplified for lower extremities, force is actively applied to the feet with each lower extremity having the force level continuously adjustable from zero force to a force equal to or greater than body-weight The exercise motions and force applications use the same major muscle groups as functional activities such as standing from a chair, climbing stairs, walking, jumping and jogging. Vertical support is provided for the lower extremity to stabilize and control the lower extremity motion within safe limits. Back support is provided for the user to exercise in a supine position. Almost any bed may be integrated with the force producing machine to form the exercise apparatus. The methods of use are adaptable to low gravity environments such as space stations, space shutfles, and other space-like environments.

The above and other objects, features and advantages of the present invention will become apparent from the following description read in conjunction with the accompanying drawings, where elements having the same identification number represent the same element in different figures.

DETAILED DESCRIPTION OF PREFERRED EMBODIMENTS

Figure 1:
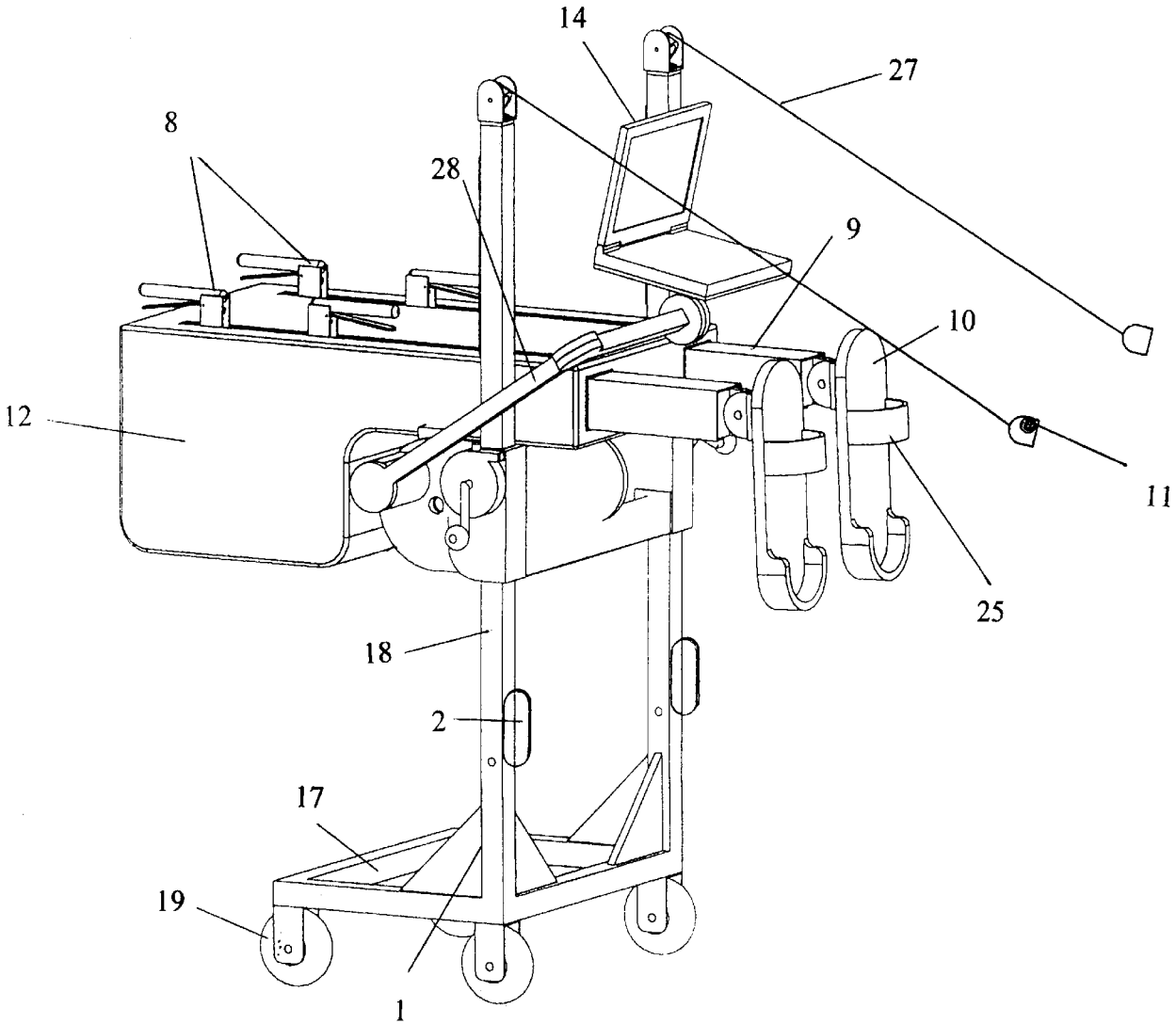
FIG. 1 illustrates a side view of a preferred embodiment.

The invention presented here uses a novel and unobvious means of providing adequate in-bed exercise for bedridden patients. The invention of this means of providing adequate exercise has overcome significant challenges that have remained unaddressed until now. Central to the invention is: a means of providing forces with the user in a bed wherein said forces meet the requirement of simulating for example the functional activity of walking. This invention offers the elements of forces that simulate functional activity with an exercising machine that is portable, programmable, versatile enough to provide rehabilitation exercise both at very low and high levels of intensity, and which can be employed with any bed.

After prolonged bedrest, one of the most challenging times for a patient is the transition from the bed to a standing position. Standing up is often complicated by postural hypertension, neurological deficits such as disturbances in body image and motor planning, balance disorders, anxiety, fear of falling and various lines and tubes attached to the patient. (Steinberg, F., *Medical Evaluation, Assessment Of Function And Potential, And Rehabilitation Plan*, In: Rehabilitation of the Aging and Elderly, G. Felsenthal, S. Garrison, F. Steinberg, Wilkins and Wilkins, Baltimore, Md. 1994; Clark, G. S., Siebens, H. C., *Rehabilitation Of The Geriatric Patient*, In Rehabilitation Medicine: Principles and Practices, Second Edition, edited by Joel A. DeLisa. J. B. Lippincott Company, Philadelphia, 1993.) Conditioning the thigh and leg muscles prior to undertaling a sit-to-stand activity to improve the odds of a safe and successfwl transfer can be accomplished by providing in-bed exercise.

The goal of improved functional mobility has guided the development of the In-Bed Exerciser embodiments. For example for an exerciser of lower extremities, emphasis is placed on developing leg extension power since power is associated with stair climbing ability (Bassey, E. J., Bendall, M. J., Pearson, *M., Muscle Strength In The Triceps Surae And Objectively Measured Customary Walking Activity In Men And Women Over* 65 *Years Of Age, Clin Sci Lond,* 74:85–89, 1988; Bassey, E. J., Fiatarone, M. A., O'Neill, E. F., Kelly, M., Evans, W. J., Lipsitz, L. A., Leg Extensor Power And Functional Performance In Very Old *Men And Women*, Clinical Sci. 82: 321–327, 1992; Skelton, D. A., Greig, C. A., Davies, J. M., Young, A., Strength, Power And Related Functional Ability Of Healthy People Aged 65–89 Years, Age and Aging. 23: 371–377, 1994; Lamb, S. E., Morse, R. E., Evans, J. G., Mobility *After Proximal Femoral Fracture: The Relevance Of Leg Extensor Power, Postural Sway And Other Factors*, Age and Aging. 24:308–314, 1995.) and is key to standing up from a chair, climbing steps and improving gait speed. (Bassey, E. J., Fiatarone, M. A., O'Neill, E. F., Kelly, M., Evans, W. J., Lipsitz, L. A., *Leg Extensor Power And Functional Performance In Very Old MenAnd Women*, Clinical Sci. 82: 321–327, 1992; Lamb, S. E., Morse, R. E., Evans, J. G., *Mobility After Proximal Femoral Fracture: The Relevance Of Leg Extensor Power, Postural Sway And Other Factors*, Age and Aging. 24: 308–314, 1995.) Forces up to and in excess of body weight can be applied as necessary during exercise motions that simulate ambulatory activity. Bodyweight-level forces or a substantial fraction thereof are required for the sufficient development of muscle mass, strength and power. (Ames Research Center, *Device for Leg Exercise in Low or Normal Gravitation*, NASA Tech Briefs, October 1996.)

The present invention permits patients who are bedridden to exercise more frequently and within safe parameters via set limit points. It quantitatively assesses the patient's lower extremity muscle capability for initial evaluation and for monitoring rehabilitation progress prior to weight-bearing. It provides physical therapists with an effective means of preparing patients for weight-bearing. It records individual exercise regimens to monitor compliance and performance as well as to facilitate the storage, duplication, and sharing of information with healthcare professionals and third party payers. The present invention also helps motivate patients by providing constant feedback on performance and progress.

Specific advantages of various embodiments of the present invention over the prior art are the following: (a) forces, up to body weight level or higher, are applied; (b) the exercise motion resembles functional activity; (c) exercise is provided for the patient without transferring the patient from the bed; (d) continuously variable force is available; (e) both concentric and eccentric exercise is provided; (f) the device is portable so it can be used by multiple usersipatients; (g) the range of motion during exercise is adjustable; (h) the means of attachment to the bed safely transfers forces to the bed frame and incorporates the bed as an integral part of the exercise apparatus; (i) support against the vertical pull of gravity is provided for the patient's extremities, e.g. legs, during the exercise motion for added safety; (j) data is recorded fiom the exercise sessions for later review by health care professionals; (k) pre-programmed or custom exercise regimes can be used; (l) the device can provide strength training, aerobic training and passive motion in any combination as well as isometric, isotonic and isokinetic exercises; (m) the vital signs such as heart rate, blood pressure and oxygen up-take can be monitored during exercise for added safety, so that if the safe limits are exceeded that exercise session is automatically terminated; and (n) patient progress can be tracked and monitored in real time, after exercise and remotely, thus this valuable information is available for physical therapists and doctors who otherwise rely on qualitative measures of functional mobility.

Figure 2:
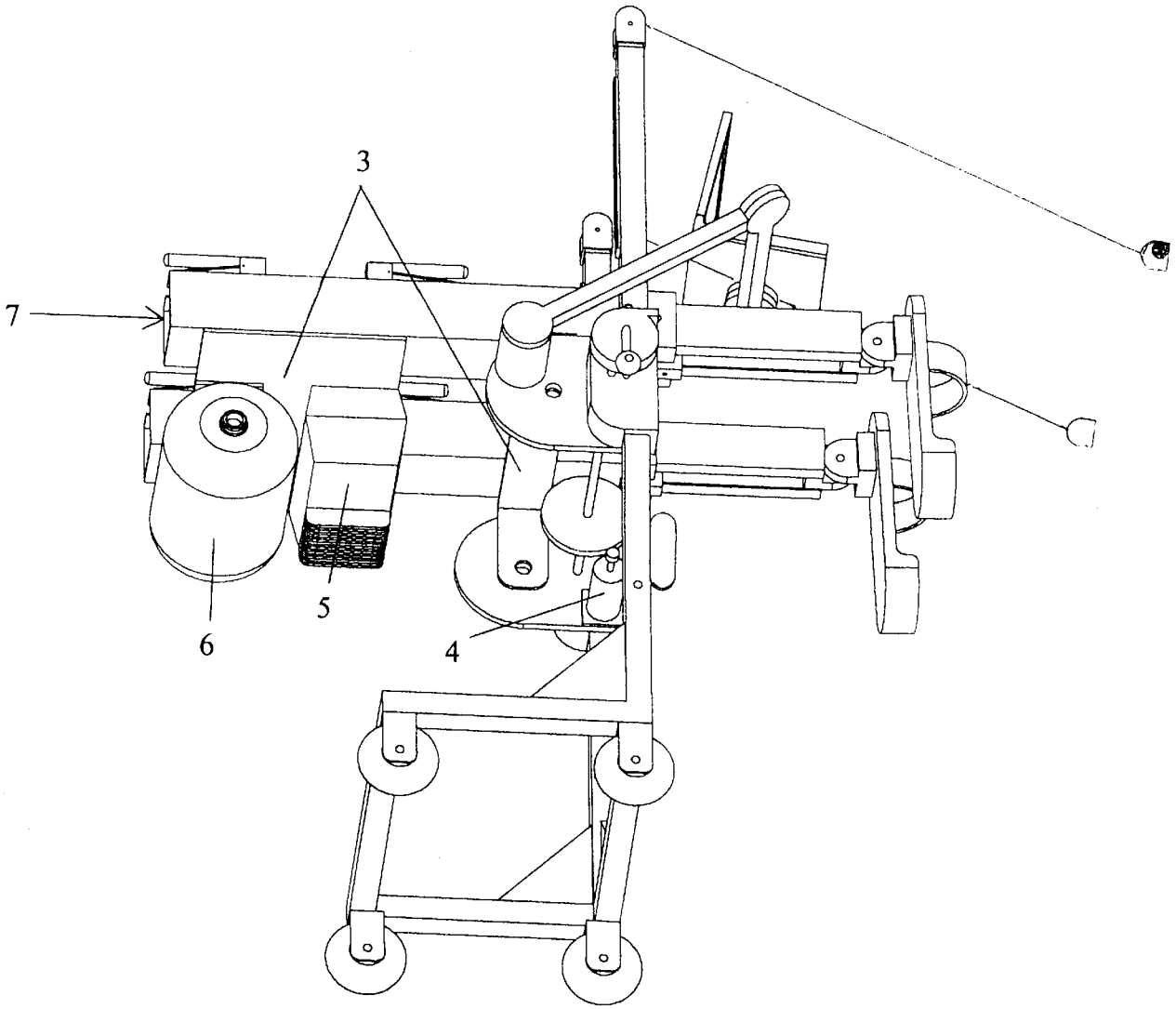
FIG. 2 shows a bottom view of the preferred embodiment of FIG. 1 with the case removed.
Figure 3:
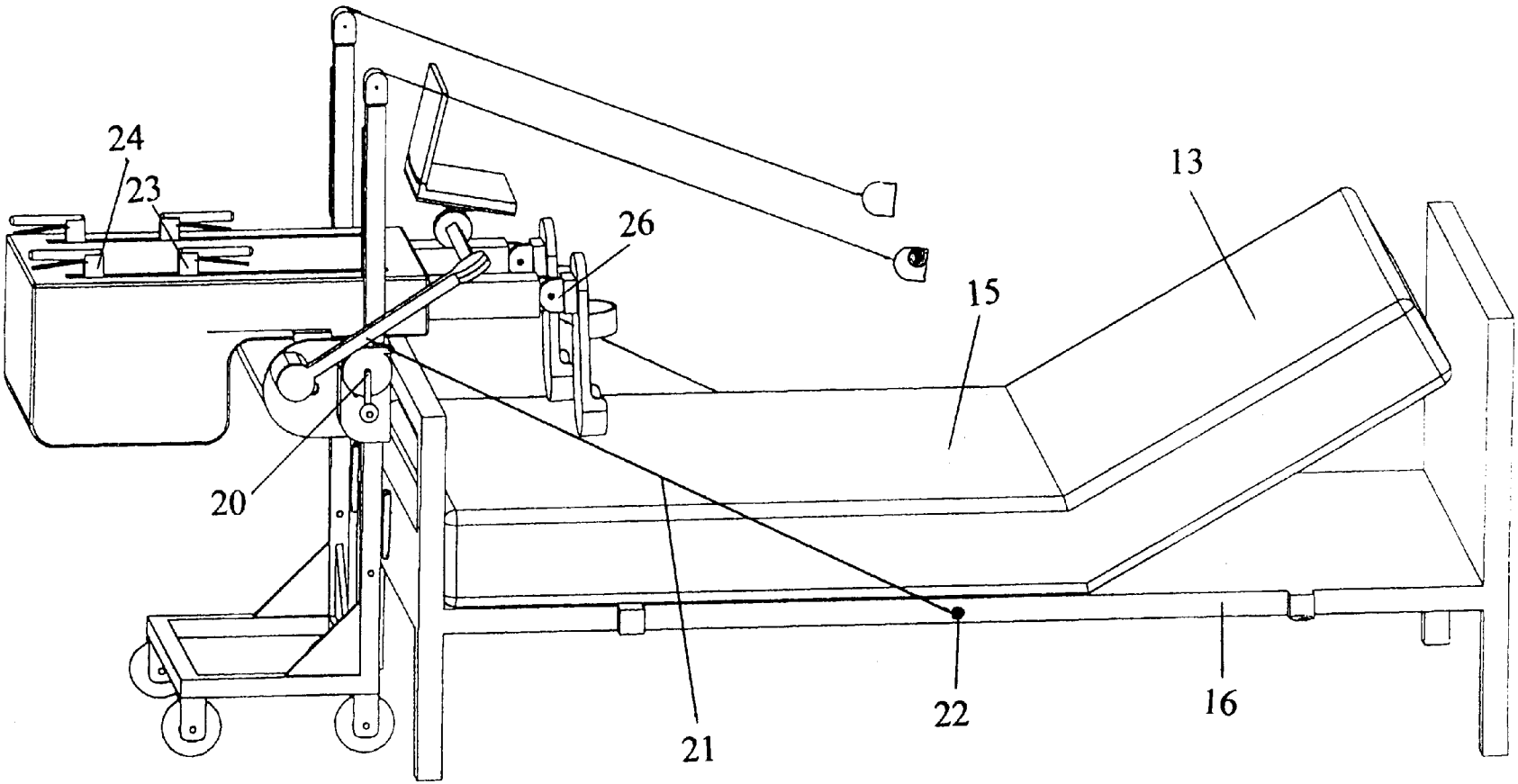
FIG. 3 presents a view of a preferred embodiment fastened to a bed.

A preferred embodiment of the invention is a pneumatically operated dynamic leg press as illustrated in FIGS. 1–3. It comprises frame 1, bed footboard bumper pads 2, structural bracket 3, height adjustment device 4, air compressor 5, air tank 6, air cylinders 7, range of motion device 8, telescoping force arms 9, foot plates 10, handles 11, case 12, back support 13 for the patient, computer data acquisition system 14 and bed 15 with bed frame 16. Structural bracket 3, air compressor 5, air tank 6, air cylinders 7, range of motion device 8, telescoping force arms 9, foot plates 10 and case 12 are collectively referred to as the exerciser unit.

Frame 1 serves two fimctions: to integrate an exerciser unit with bed frame 16 in such a manner that body-weight-level or higher forces and reaction forces can be safely applied, and to support structural bracket 3, positioned appropriately at the foot of the bed. Frame 1 is comprised of base 17, vertical support beams 18, and castors 19. The bed securing device secures the In-Bed Exerciser frame to the bed fiame. The bed-securing device is comprised of two ratchet mechanism 20, two straps 21, and two hooks 22. Structural bracket 3 is comprised of support members for air tank 6, air compressor 5, air cylinders 7 and telescoping force arms 9. The height adjustment device is comprised of a means for raising and lowering the structural bracket on the vertical support beams. The air compressor is used to pressurize the air tank. The air tank provides energy storage. The air cylinders transfer force to the foot plates. The range of motion device sets flexion 23 and extension 24 stops for telescoping force arms 9. The telescoping force arms support the foot plates and the air cylinders and prevent twisting, or any kind of misaligned motion. Foot plate 10 is attached to telescoping force arm 9 and is further comprised of foot securing strap 25 and angle adjustment device 26. The patient's feet are strapped to the foot plates and force is transferred from the foot plates to the patient's feet The reaction force from the patient is transferred through the patient's hips and back to the back support. The patient's force is transferred from the back support to the bed frame and through the bed frame to the in-Bed Exerciser frame, essentially forming a closed loop.

Handles 11 provide a grip for the patient to use during exercise. Mounted on the handles are safety shut off switches. Case 12 covers the exerciser unit. The back support is comprised of a wedge used to incline the patient to a supine position and to receive the reaction forces during exercise. On a bed that has a built-in back inclination feature, a back support as a separate unit is not needed. The computer data acquisition system comprises computer 14 having a data acquisition system, and support arm 28 to hold computer 14. The support arm is capable of positioning the computer for easy access by an attendant or for convenient display to the patient during exercise. The bed can be any standard hospital or home-style bed.

Figure 4:
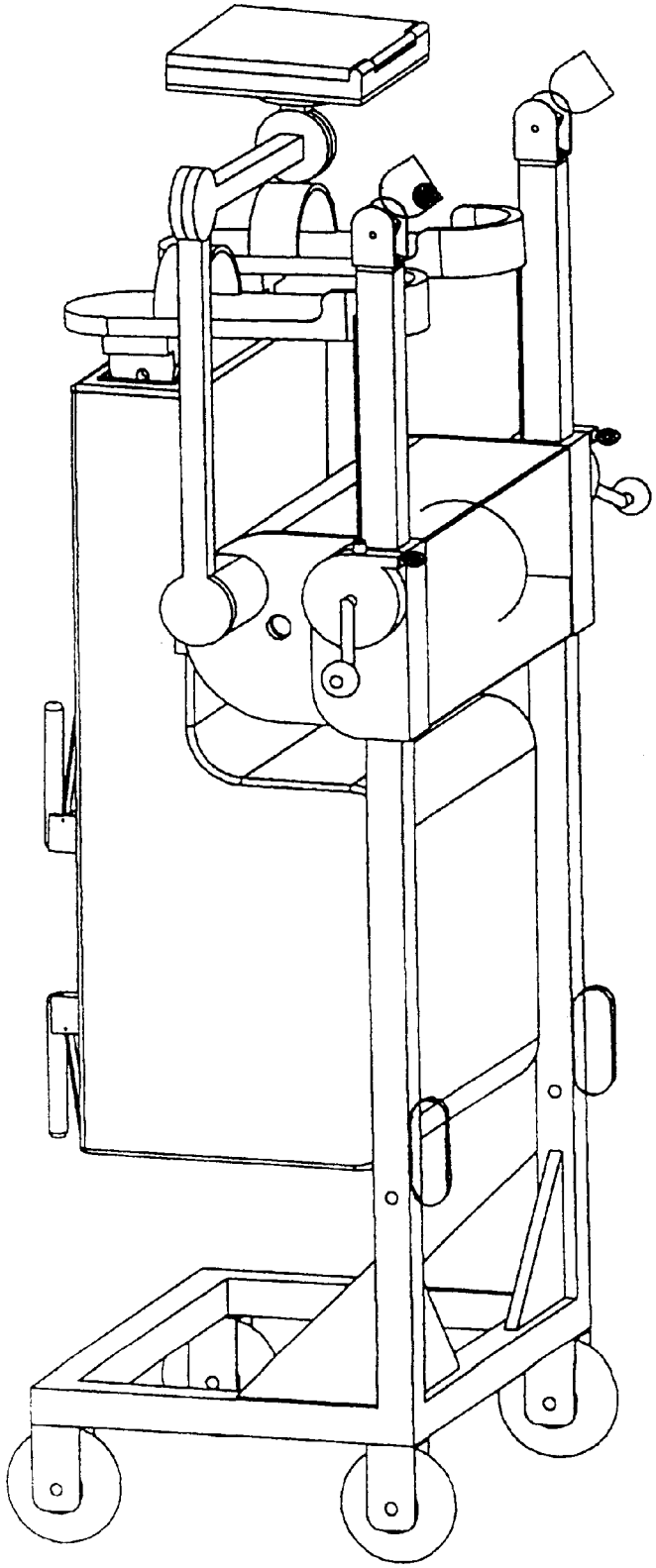
FIG. 4 illustrates a preferred embodiment which has been collapsed for transportation and storage.
Figure 5:
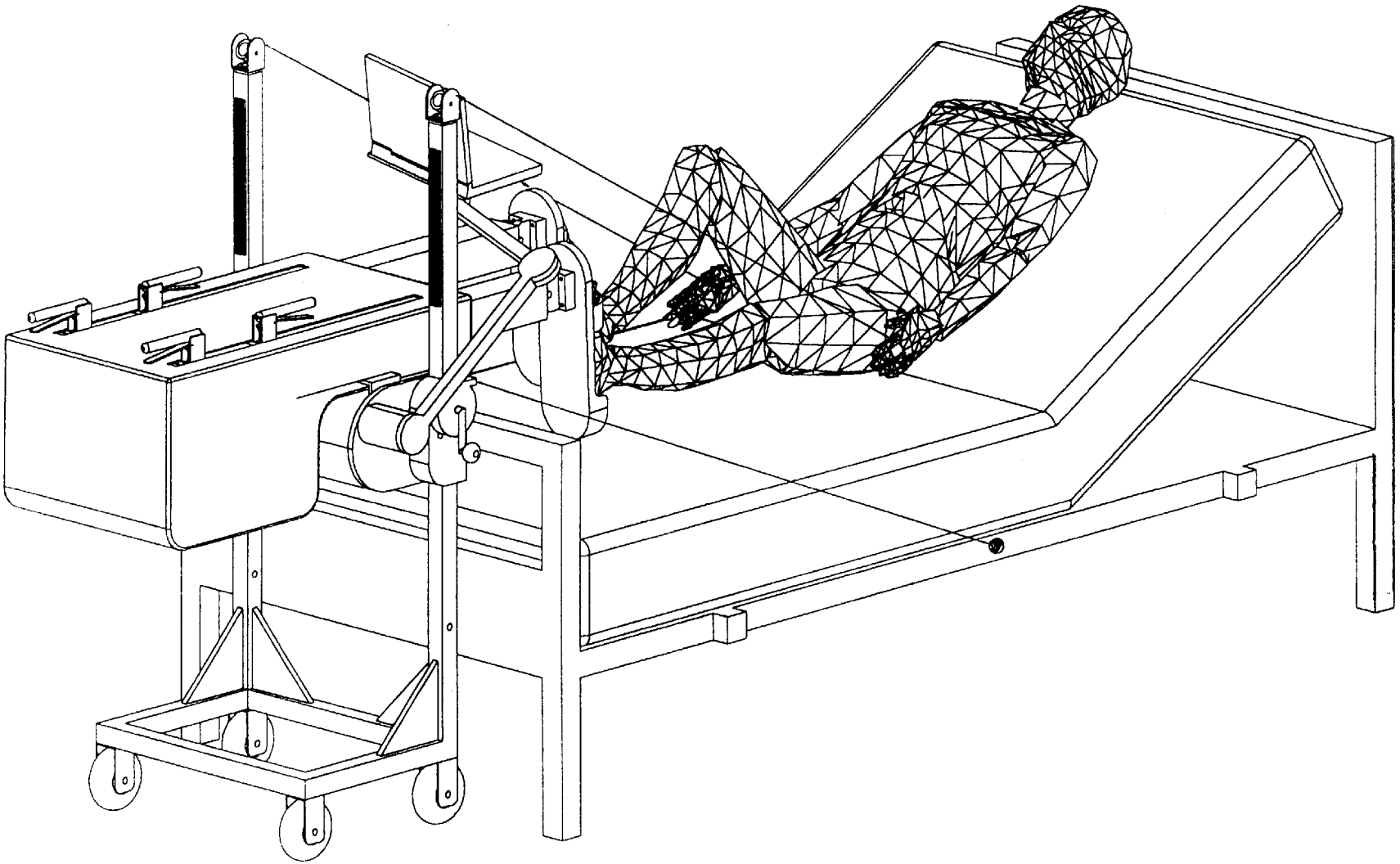
FIG. 5 illustrates a preferred embodiment in the operating position and in use.

FIG. 4 illustrates an embodiment of the In-Bed Exerciser collapsed for transportation to another patient or bed, or for storage. In FIG. 5, a preferred embodiment of the exerciser is schematically shown with an exerciser positioned in bed and using the invention to exercise their lower extremity muscles and ligaments.

Figure 6:
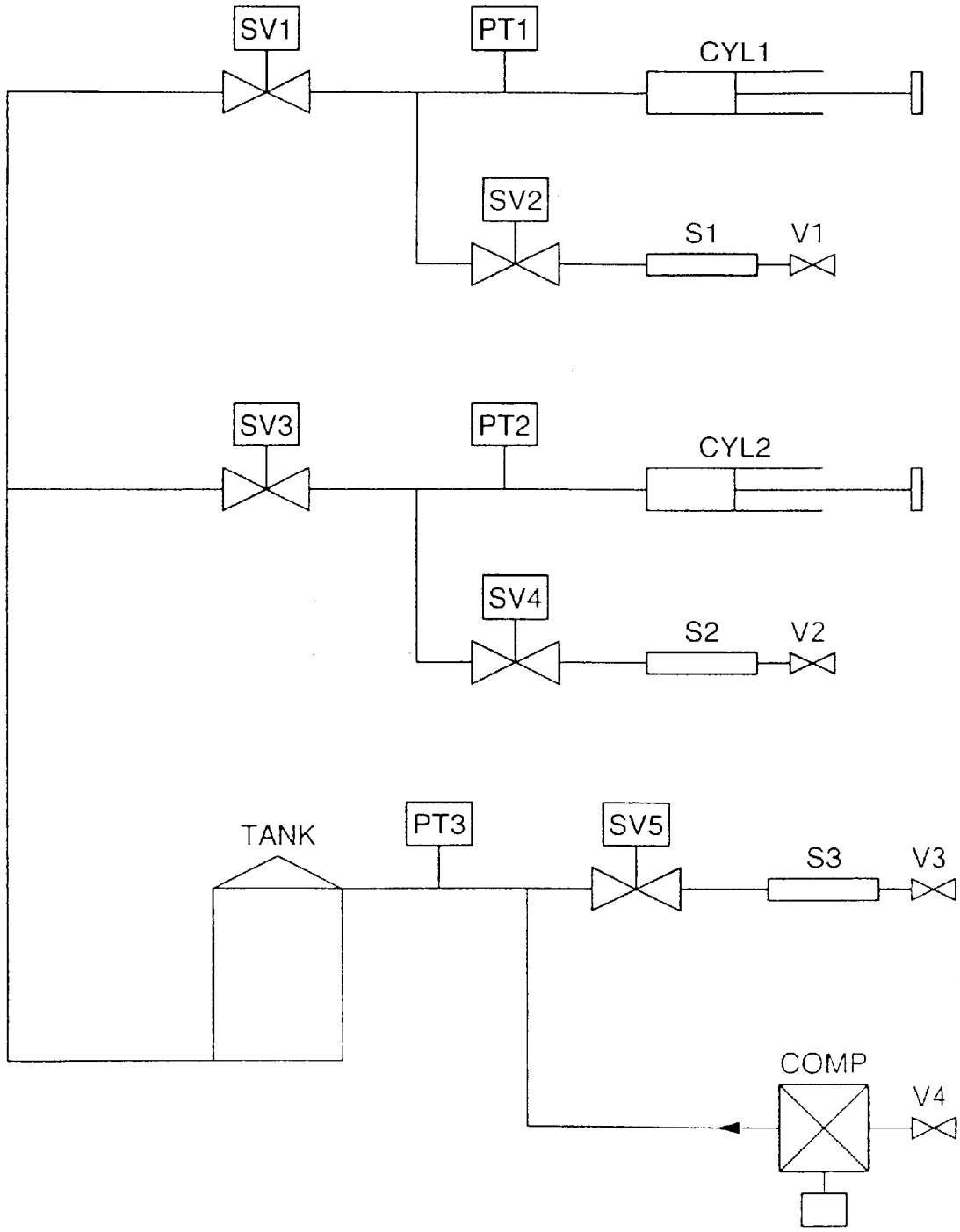
FIG. 6 schematically show a pneumatic system for preferred embodiments.

The pneumatic system, which is schematically shown in FIG. 6, is comprised of solenoid valves, pressure transducers, air cylinders, silencers, vents, the air tank and the air compressor. The pneumatic system has four possible states: 1) setup, 2) ready, 3) run, 4) off. During setup mode: the air tank is pressurized by closing solenoid valves SV1, SV3, and SV5 and then turning on the air compressor. Solenoid valves SV2 and SV4 are opened so that the air cylinders are free to move for positioning purposes. During ready mode: the air compressor is shut off, solenoid valves SV1, SV3, and SV5 are closed and solenoid valves SV2 and SV4 are opened. During run mode: Solenoid valves SV2, SV4, and SV5 are closed and either or both of solenoid valves SV1 and SV3 are opened. The air compressor is off. This applies compressed air to either or both of air cylinders CYL1 and CYL2. During off mode: Solenoid valves SV2, SV4, and SV5 are opened and solenoid valves SV1 and SV3 are closed. The air compressor is off. This discharges all compressed air from the system through silencers S1, S2 and S3 and vents V1, V2, and V3. V4 silences the compressor inlet.

Other embodiments include: variations in the means of force production, in the means of height adjustment, variations in the means of supporting the patient's feet, in the means of providing grips for the patients hands, variations in the placement of the data acquisition computer, variations in the materials used for construction of the frame and other components, variations in the overall layout of the invention's components, or variations in the pneumatic cylinder mountings.

In this invention, the force is applied actively both in the direction of motion and opposing the direction of motion during extension and flexion respectively. The active application of force requires that mechanical energy is either dynamically produced with a device such as an electric, hydraulic, or pneumatic motor or that mechanical energy is stored with a device such as a mechanical or pneumatic spring, an electrical capacitor or battery, or by lifting weights. The force level is continuously adjustable from zero force up to force levels associated with functional activities. Examples of alternative force production devices include the use of rubber balloons as a constant pressure reservoir, wherein the constant pressure is adjustable by mechanically deforming the rubber balloons, or electric motor-drivevn screw thrusters. The constant pressure reservoir could also be accomplished by means of a hydraulic pump, water pressure, a pressurized gas reservoir, or mechanical means. Various spring configurations could be used such as a constant force spring with a mechanical means of adjusting the force level, linear or non-linear springs with mechanical means to achieve constant force output. The force can be transmitted to the foot plates with hydraulic cylinders, bellows, chains, cables or mechanical linkages.

The means of height adjustment can include but is not limited to hydraulic mechanisms, electric motor drive systems, mechanical crank systems and hydraulic systems. The data acquisition computer can be mounted with a support arm or can be integrated into the design. Other materials may be used for the construction of the flame such as aluminum, steel, wood, carbon-fiber reinforced polymers, or other composite materials. Materials are best chosen by considering cost, weight and performance of each material.

Figure 7:
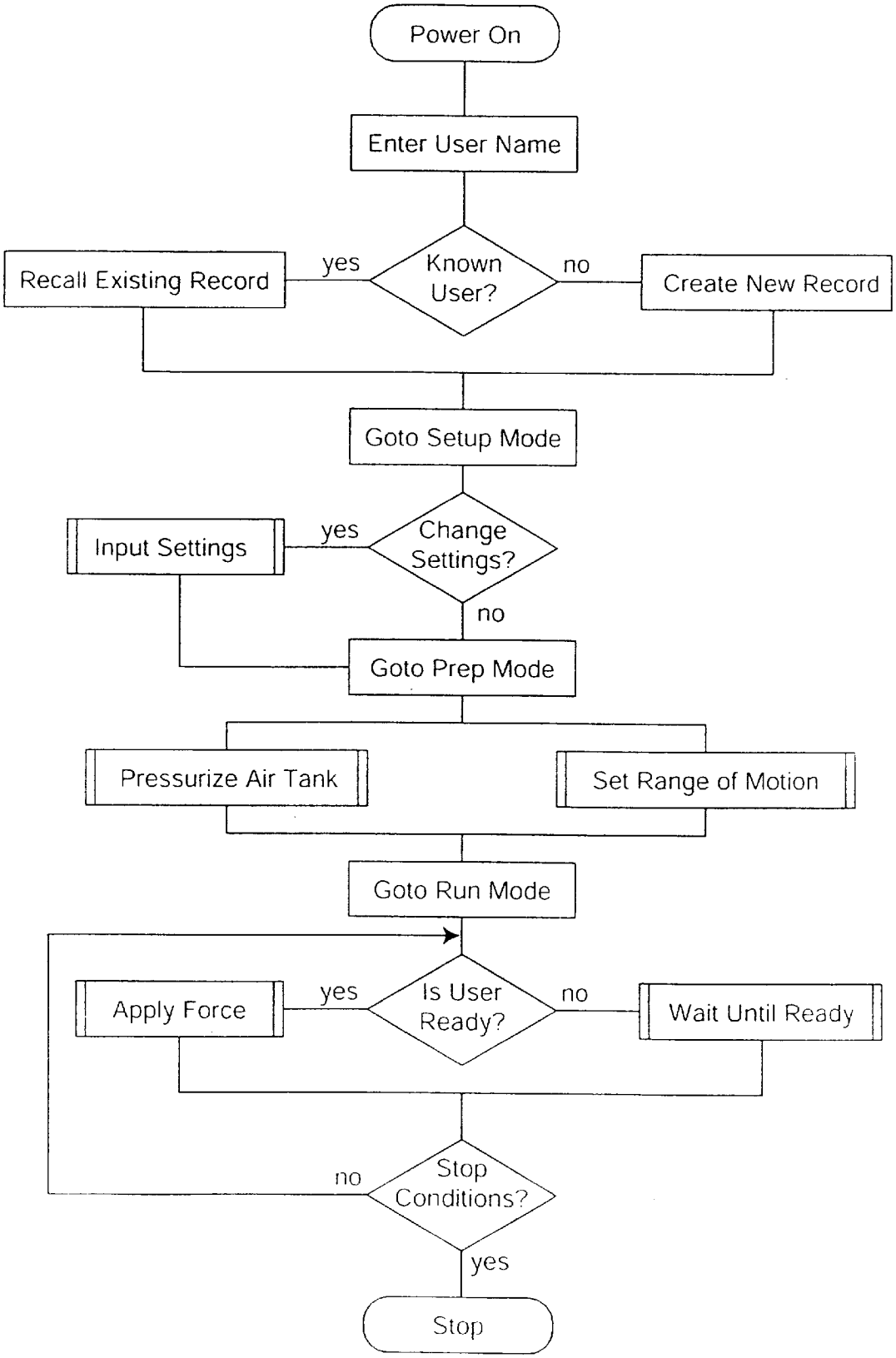
In FIG. 7, a sample interface logic for a preferred embodiment is presented.

The patient's performance monitored by the computer data acquisition system can be used to interact with the patient in many ways. In FIG. 7 one sample of interface logic is illustrated. For example, if the patient produces insufficient force then the In-Bed Exerciser could shut off the applied force or with sensor feedback match the applied force to the patient's force. The force level could be regulated to help the patient reach a target heart rate or metabolic rate. The patient could also play exercise games by interacting with the computer.

The overall layout of the components of the invention may be changed while achieving the same function. For example: the handle cables may be fastened to either the In-Bed Exerciser frame, to the height adjustment mechanism or the structural bracket. The bed stabilization mechanism can be attached to either the In-Bed Exerciser frame, the height adjustment unit or the structural bracket. The means of supporting the patient's legs could be a single stage, or multi-stage telescoping assembly. The force production and energy storage elements can be positioned above or below the means of supporting the patient's legs. The main frame can be configured with two, three, four or more wheels. They castors can be rotating, locking, or non-locking.

The In-Bed Exercise machine can be adapted to interact with the patient and provide assistance for the exercise motion as needed to allow the patient to progress gradually from a need for extensive assistance to independent motion and eventually to independent function in the activities of daily living. In this way, this invention can perform the job of a passive motion machine, a strength training exercise machine, an aerobic exercising machine and is able to perform at infinitely many levels between all of those extremes.

There are many different sensors that monitor bodily processes and vital signs that can be inputted into the data acquisition computer to monitor the patient's health and well-being, to maintain safety and to provide biofeedback for exercise machine control. Such sensors include oxygen uptake monitors, blood pressure monitors, heart rate monitors, EMG monitors, EEG monitors, force and speed sensors.

The In-Bed Exercise machine can be easily transported in buildings that are handicapped-accessible by one attendant pushing it. The castors on the main frame have large enough wheels to provide low friction on for example: rugs, ramps, doorways, gravel and grass. The attendant then wheels the In-Bed Exerciser up to the foot of the bed until the bumper pads contact the foot of the bed approximately at the height of the bed frame. The attendant then rotates the exerciser unit from the vertical storage position (as shown in FIG. 4) to the horizontal position of use. The exerciser unit is balanced with springs or air cylinders (not shown) so that the attendant is not required to apply more than minimal force to rotate the exerciser unit. The attendant then uses height adjustment device to adjust the height of the force arms and foot plates to the desire height above the bed appropriate for performance of exercise, fastens the hooks from the bed stabilization system onto the bed frame and tightens the straps that connect the bed frame to the In-Bed Exerciser frame. The straps are ratcheted tight. The attendant positions the handles for the patient to hold on to conveniently. The attendant then plugs the In-Bed Exerciser power cord into a standard household wall socket and turns on the power switch. The attendant then sets the range of motion stops for the patient and selects the force level with a dial or with the computer interface. The attendant could alternatively load the patient's exercise regiment into the In-Bed Exerciser computer via a tape, a CD disc, a card or manually.

When the patient is ready, the attendant then turns on the forces to actively apply force to the patient The patient alternatively has the option of turning on the force with a remote switch that is located on the handle the patient is holding. The attendant will also position the data acquisition computer system screen so that the patient can watch his or her performance while exercising. The In-Bed Exerciser can now be used for exercise in the aerobic and strength training modes. During an aerobic exercise the data acquisition computer will display information on work done during exercise. During strength training mode the data acquisition computer will report on the force levels and number of repetitions. Exercise sessions may consist of multiple stages where different force settings and number of repetitions are used.

The exercise session will be automatically terminated if the patient's heart rate exceeds certain limits specified in the data acquisition computer, or if the patient releases the stop/start buttons located on the handles which act as automatic shut off switches. Terminating an exercise session means that the force actively applied to the patient will be reduced to zero immediately. The range of motion stops prevent the patient from moving beyond the specified range and prevent the force producing cylinders from making more leg flexion than intended. To limit leg extension, in case the patient slips rearward, a pillow or inflated bag can be placed under legs.

All of the patient's exercise performance data can be recorded by the data-acquisition computer for later review by health care professionals. Instant feedback can also be provided for the patient and the attendant if present. When the specified duration of exercise or the specified number of repetitions is reached, the patient releases the stop/start buttons, or the attendant presses the stop button or the computer commands STOP, and the force is removed from the patient's feet. Now patients can take their feet off of the foot plates. The attendant then returns the exerciser unit to the vertical position, collapses the grips and returns the data acquisition computer to its storage position. Next the attendant will detach the bed attachment device from the bed fiame, and wheel the In-Bed Exerciser away from the foot board of the bed. The attendant can now remove the back support from the bed or recline the back support on a bed with that feature built-in. The Exerciser can now be wheeled to another patient's bed, or to storage.

The incorporation of In-Bed Exerciser into a rehabilitation program benefits patient by providing adequate exercise in the context of the bed. The professional therapist is able to serve patients more efficiently because the Exerciser can be set up for use and monitored by a non-professional attendant and the In-Bed Exerciser can conduct the exercise regime prescribed by the therapist. A therapist who can only visit a patient a few times a week can use In-Bed Exerciser to have the patient exercising even three times a day. The therapist could monitor the patient's performance remotely in real time or at a later date since the data is recorded.

This invention is not restricted to in-hospital use, but can also be used in a nursing home, or a home care setting. This invention can be used by the elderly, the middle-aged and by children. The use of this invention is not restricted to rehabilitation. The invention can be used by anyone who needs to maintain and build strength and functional ability, or who would benefit from exercise sufficient to promote a conditioning effect.

The invention may be incorporated with other technologies such as physical diagnostic programs and rehabilitation programs for cerebral vascular accident or other trauma victims. The advantage of using this invention as part of the rehabilitation program is that it is able to quantify the patient's progress and provide greater feedback during exercise to the patient. This feedback is especially important because it is a source of motivation for the patient to continue exercising and following the exercise regime. Methods exist for enhancing this invention's ability to motivate the patient to exercise. For example, the patient's brain wave activity could be monitored and processed by the data acquisition computer to respond appropriately to the patient's state of mind. This sort of bio-feedback exercise rehabilitation is made possible by this invention.

The exercise and rehabilitation technology of this invention could be built into a bed where the exercise machine collapses into the foot board of the bed for example. This would provide every patient who uses one of these beds the opportunity to have access to passive motion, strength training and aerobic exercise equipment without transferring from the bed.

While the principles of the invention have been illustrated with lower extremity exercises, where the greatest difficulty with the present state-of-the-art exists, the concepts and principles of the invention are equally applicable to upper extremity exercises, additional lower extremity exercises and to exercises for the muscles of the chest, back and abdomen. With this invention, there no longer is a limit to the number of exercises that can be provided at bed side by applying the technology disclosed herein.

Furthermore, since the invention can provide body-weight-level forces without the use of gravity, this same exercise technology can be used in space by astronauts to maintain muscle mass and strength during extended periods of weightlessness. The exercise device of this invention is adaptable to use in space because of its light weight, versatility as well as its ability to provide body-weight-level forces without the use of gravity.

Throughout this description the term 'patient' includes anyone who could benefit from exercise while in a supine or sitting position. An attendant generally can be a physical therapist, a certified nurse's assistant, an orderly or anyone else who can help set up the equipment, monitor it in use and either can input necessary information or is under the direction of an appropriate professional, who can provide the information.

Having described preferred embodiments of the invention with reference to the accompanying drawings. It is to be understood that the invention is not limited to these precise embodiments, and that various changes and modifications may be effected herein by those skilled in the art without departing from the scope or spirit of the invention as defined in the appended claims.

What is claimed is:

1. A method of 'in-bed' exercise to strengthen and maintain muscle groups necessary for normal human functional activities, while exerciser is sitting or reclining in bed, comprising the steps of:

(a) attaching a portable in-bed exercise machine to a bed in a safe and secure manner, whereby said bed and said exercise machine become an integrated unit, forming a closed force loop during exercise periods;

(b) placing said exerciser's extremities, which are to be exercised, into appropriate, adjustable, force arms of said exercise machine;

(c) applying programmed isometric, isotonic, or isokinetic forces actively to provide concentric and eccentric closed kinetic chain exercise, said forces being applied both in the direction of the motion of said force arms and in opposition to the direction of motion of said force arms;

(d) regulating action of said exercise machine through its programmable control system to allow bilateral, unilateral and reciprocal exercise at forces up to body weight level and under exercise regimens simulating muscle actions used in performing normal human functional activities.

2. The method of in-bed exercise according to claim 1, further comprising the steps of:

(e) recording and storing performance data and exercise regimen with said exercise machine's data acquisition and storage system; and (f) printing or displaying said performance data and said exercise regimen.

3. The method of in-bed exercise according to claim 1, wherein said application of force in step (c) is applied in a graduated fashion over a predetermined time interval until reaching a predetermined set force level.

4. The method of in-bed exercise according to claim 2, further comprising a step of:

(g) interfacing programming control with a visual display device and a data input device and providing visual or aural operation control and performance feedback.

5. The method of in-bed exercise according to claim 2, further comprising the steps of:

(h) interconnecting said programmable control system and said data acquisition system with at least one vitals signs monitor, all emergency stop switches, all pressure/force transducers, and position sensors, to recording and logic means components of said exercise machine; and (i) automatically shutting down said exercise machine when recorded data exceeds preprogrammed limit values of vital signs.

6. The method of in-bed exercise according to claim 2, further comprising the steps of:

(j) collecting substantially continuous data on velocity and acceleration of said force arms and force applied by user and then storing or using such data to calculate and report instantaneous power and total work applied by user.

7. The method of in-bed exercise according to claim 1, wherein said force source is applied to adjustable, force arms of said exercise machine so as to provide reversing forces during incursion and excursion for use of the machine as a passive motion machine such that no work is required of the user.

8. The method of in-bed exercise according to claim 1, wherein exercises are done in an environment of low gravity.

9. The method of in-bed exercise according to claim 8, wherein said low gravity environment is a space vehicle, including a space station and a space satellite.

* * * * *